US006361355B1

(12) United States Patent
Matsuoka et al.

(10) Patent No.: US 6,361,355 B1
(45) Date of Patent: Mar. 26, 2002

(54) SPLICE ABSORBING CONNECTOR HAVING A PLURALITY OF SUB-HOUSINGS STUCK TOGETHER

(75) Inventors: Yutaka Matsuoka; Masami Sakamoto, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/518,078

(22) Filed: Mar. 3, 2000

(30) Foreign Application Priority Data

Mar. 3, 1999 (JP) ..... 11-055055

(51) Int. Cl.[7] ..... H01R 3/00
(52) U.S. Cl. ..... 439/488; 439/701
(58) Field of Search ..... 439/545, 488, 439/701, 928, 717

(56) References Cited

U.S. PATENT DOCUMENTS 2,857,583 A * 10/1958 Markley et al. ..... 439/488
3,605,068 A * 9/1971 Rayburn ..... 439/291
5,462,442 A * 10/1995 Umemura et al. ..... 439/69

FOREIGN PATENT DOCUMENTS

DE 197 09 694 A1 10/1998
JP 48-30784 4/1973
JP 48-30785 4/1973
JP 49-52091 5/1974
JP 4-115785 10/1992 ..... H01R/23/68
JP 5-61984 8/1993 ..... H01R/23/02
JP 7-326447 12/1995 ..... H01R/31/08
JP 8-222291 8/1996 ..... H01R/9/07
JP 9-237668 9/1997 ..... H01R/31/08

OTHER PUBLICATIONS

Ready Index–Contemporary Table of Contents Divider, AVERY R121310, Avery Dennison, No Date.*

* cited by examiner

*Primary Examiner*—Brian Sircus
*Assistant Examiner*—Hae Moon Hyeon
(74) *Attorney, Agent, or Firm*—Sughrue Mion, PLLC

(57) ABSTRACT

In a splice-absorbing connector, a connector housing (20) comprises a plurality of sub-housings stacked (20A, 20B, . . . ) together. Order identification portions (40), which mean stack order positions of the sub-housings (20A, 20B, . . . ), respectively, and are different in appearance from one another, are formed respectively on one surfaces (20*a*) of the sub-housings (20A, 20B, . . . ) which do not overlap each other, and are disposed in a common plane. When the sub-housings (20A, 20B, . . . ) are stacked together in correct order, the order identification portions (40) of these sub-housings (20A, 20B, . . . ) jointly form a pattern of a predetermined regularity.

11 Claims, 15 Drawing Sheets

SPLICE ABSORBING CONNECTOR HAVING A PLURALITY OF SUB-HOUSINGS STUCK TOGETHER

BACKGROUND OF INVENTION

1. Field of Invention

This invention relates to a splice-absorbing connector which eliminates a splice between wires, branched respectively from sub-harnesses, and more particularly to a splice-absorbing connector in which a plurality of sub-housings are stacked together to form a connector housing.

2. Related Art

FIG. 14 shows a partially cross sectional view of a conventional joint absorbing connector, and the detailed description is described hereinbelow. In FIG. 14, a reference numeral 100' is a joint absorbing connector such that a bus bar 120' is inserted into a connector housing 110' made of a resin. A plurality of connector fitting portion 111' are integrally molded to the connector housing 110', and tub terminals 121' erect from the bus bar 120' at an inner side of the connector fitting portion.

Wires are branched from sub-harnesses more than two pieces (not shown), and a mating connector (male connector) is attached with each wire. Each mating connector is fitted to each connector fitting portion 111 ' of the connector housing 110' to connect wires branched from sub-harnesses to each other so as to form a wire-harness.

Next, a conventional splice absorbing connector will described along with FIGS. 15 and 16. FIG. 15 shows a conventional splice absorbing connector; FIG. 15(*a*) shows a transverse sectional view and FIG. 15(*b*) shows a longitudinal cross sectional view. FIG. 16 shows an illustration of a connecting condition of the sub-harness through the splice absorbing connector. In FIGS. 15(*a*) and (*b*), a connector housing 210' of a splice absorbing connector 200' has terminal accommodating chambers 211' divided by a plurality of holding grooves 212'.

On the other hand, wires 31*a*' and 32*a*' are divided from at least more than two sub-harnesses (as shown in FIG. 16). A terminal 220' is press-fitted to each wires 31*a*' and 32*a*', and has an elastic contact portion 221'.

As shown in FIGS. 16 and 15(*a*), after assembling the sub-harnesses 31' and 32', each terminal 220' of the wire 31*a*', and 32*a* is fitted into each holding groove 212 of a connector housing 210' so that the terminals 220' adjacent each other are elastically contacted in the terminal accommodating chambers 211' to connect the wires 31*a*' and 32*a*' each other so as to form the wire harness.

However, in the conventional joint absorbing connector 100', the structure of the connector housing 110' and bus bar 120' are determined in accordance with a number of wires branched from sub-harness 31' or the bus-bar 120'. Thus, when the sub-harness condition is changed, the housing 110' or the bus bar 120' is newly designed along with the sub-harness condition. Namely, the conventional joint absorbing connector 100' could not flexibility follow the change of the sub-harness condition.

Further, this structure requires the joint absorbing connector 100' and a mating connector fitted to the joint absorbing connector 100'. As a result, the circuit located in an automobile is increased and the joint absorbing connector 110' becomes large along with the complication.

Moreover, in the splice absorbing connector 200', after assembling the sub-harness 31' and 32', each terminal 220' press-fitted to the wire 31*a*' or 32*a*' branched from the sub-harnesses 31' or 32' is press-fitted into the each holding groove 212' of the connector housing 210'. This work lead to the reduce the workability of wire harness.

Further, each terminal 220' is connected in a transverse or longitudinal direction. As a result, the circuit located in an automobile is increased, and the joint absorbing connector 110' becomes in large in the transverse or longitudinal direction along with the complication.

SUMMARY OF INVENTION

With the above problem in view, it is an object of the present invention to provide a splice-absorbing connector in which the connector construction can flexibly meet a change in the number of wires, the overall size of connector can be made compact and the efficiency of production of the wire harness can be enhanced.

It is another object of this invention to provide a splice-absorbing connector in which the order of stacking of sub-housings can be clearly identified from the appearance so that an error in the order of stacking of the sub-housings can be prevented and that it can be immediately judged where and how the stacking order is erroneous.

According to the present invention, there is provided a splice-absorbing connector wherein a connector housing comprises a plurality of sub-housings stacked together;

provided in that order identification portions, which mean stack order positions of the sub-housings, respectively, and are different in appearance from one another, are formed respectively on one surfaces of the sub-housings which do not overlap each other, and are disposed in a common plane. For example, the order identification portion of each of the sub-housings comprises a number mark indicated on the one surface thereof, and the number of the number mark of each sub-housing is the same as the stack order position number thereof.

With this construction, when assembling the splice-absorbing connector, the sub-housings are stacked together in accordance with the order identification portions (numbers or others) formed respectively on the one surfaces of the sub-housings, and by doing so, an error in the stacking order can be prevented.

Preferably, when the sub-housings are stacked together in correct order, the order identification portions of the sub-housings jointly form a pattern of a predetermined regularity.

For example, the order identification portion of each of the sub-housings comprises three-dimensional or planar marks which are formed on the one surface thereof at equal intervals in a juxtaposed manner, and the number of the marks is the same as the stack order position number thereof. Alternatively, the order identification portions of the sub-housings are formed respectively by different colors applied respectively to the one surfaces of the sub-housings.

With this construction, when assembling the splice-absorbing connector, the sub-housings are stacked together in accordance with the order identification portions (three-dimensional or planar marks or colors corresponding to the respective stack order positions) formed respectively on the one surfaces of the sub-housings, and by doing so, an error in the stacking order can be prevented.

When the sub-housings are stacked together in the correct order, the order identification portions of these sub-housings jointly form the pattern of the predetermined regularity. Therefore, the operator, when taking a look at this pattern, can immediately judge whether or not the stacking order is correct, and also can immediately judge where and how the stacking order is erroneous.

For example, the order identification portion of each of the sub-housings comprises three-dimensional or planar marks whose number is the same as the stack order position number thereof. In this case, when the sub-housings are stacked together in the correct order, the three-dimensional or planar marks of the order identification portions jointly form such a three-dimensional or planar configuration pattern of a predetermined regularity that the number of the marks is increased one by one in the sequence from the first-stage sub-housing toward the last-stage sub-housing.

For example, the order identification portions of the sub-housings are formed respectively by different colors applied respectively to the one surfaces of the sub-housings. In this case, when the sub-housings are stacked together in the correct order, the colors of these sub-housings are arranged in a predetermined order (for example, red→green→blue, . . . ), thereby jointly forming a color pattern of a predetermined regularity.

The operator takes a look at such a three-dimensional or planar configuration pattern or a color pattern to determine whether or not this pattern has the predetermined regularity, and merely by doing so, it can be immediately judged whether or not the stacking order is correct, and also it can be immediately judged where and how the stacking order is erroneous.

Preferably, part or the whole of the one surface of each of the sub-housings is structurally or imaginarily divided into sections equal in number to the sub-housings stacked together, and these sections form the order identification portion, and that section of the sections of each sub-housing, corresponding to the stack order position thereof, is different in appearance from the other sections.

For example, a number mark is indicated on that section of the sections of the order identification portion of each sub-housing, corresponding to the stack order position thereof, and the number of the number mark of each sub-housing is the same as the stack order position number thereof.

With this construction, the sub-housings are stacked together in accordance with the number marks indicated respectively on the sub-housings, and by doing so, an error in the stacking order can be prevented.

When the sub-housings are stacked together in the correct order, the number marks, formed respectively on the order identification portions of the sub-housings, are arranged straight on a diagonal line of the stacked sub-housings, thus jointly forming a pattern of a predetermined regularity.

For example, a three-dimensional or planar mark may be formed on that section of the sections of the order identification portion of each sub-housing corresponding to the stack order position thereof. Also, three-dimensional or planar marks may be formed respectively on the sections of the order identification portion of each sub-housing except that section corresponding to the stack order position thereof.

With this construction, the stack order position of each sub-housing can be identified in accordance with the position of the three-dimensional or planar mark at the order identification portion thereof, or in accordance with the position of that section having no three-dimensional or planar make formed thereon, and therefore an error in the stacking order can be prevented.

When the sub-housings are stacked together in the correct order, the three-dimensional or planar marks (formed respectively on the order identification portions) or those sections of these sub-housings, each having no three-dimensional or planar mark formed on the order identification portion, are arranged straight on a diagonal line of the stacked sub-housings, thus jointly forming a pattern of a predetermined regularity.

For example, a color may be applied to that section of the sections of the order identification portion of each sub-housing corresponding to the stack order position thereof. Also, a color may be applied to the sections of the order identification portion of each sub-housing except that section corresponding to the stack order position thereof.

With this construction, the stack order position of each sub-housing can be identified in accordance with the position of that section of the order identification portion having the color, or in accordance with the position of that section of the order identification portion having no color, and therefore an error in the order of stacking of the sub-housings can be prevented.

When the sub-housings are stacked together in the correct order, those sections of the order identification portions having the color, or those sections having no color, are arranged straight on a diagonal line of the stacked sub-housings, thus jointly forming a pattern of a predetermined regularity.

BRIEF DESCRIPTION OF DRAWINGS

FIG. 15(*a*) shows a transverse sectional view and FIG. 15(*b*) shows a longitudinal cross sectional view.

DETAILED DESCRIPTION OF PREFERRED EMBODIMENTS

Preferred embodiments of splice-absorbing connectors of the present invention will now be described.

Basic Structure of Splice-Absorbing Connectors

Figure 10:
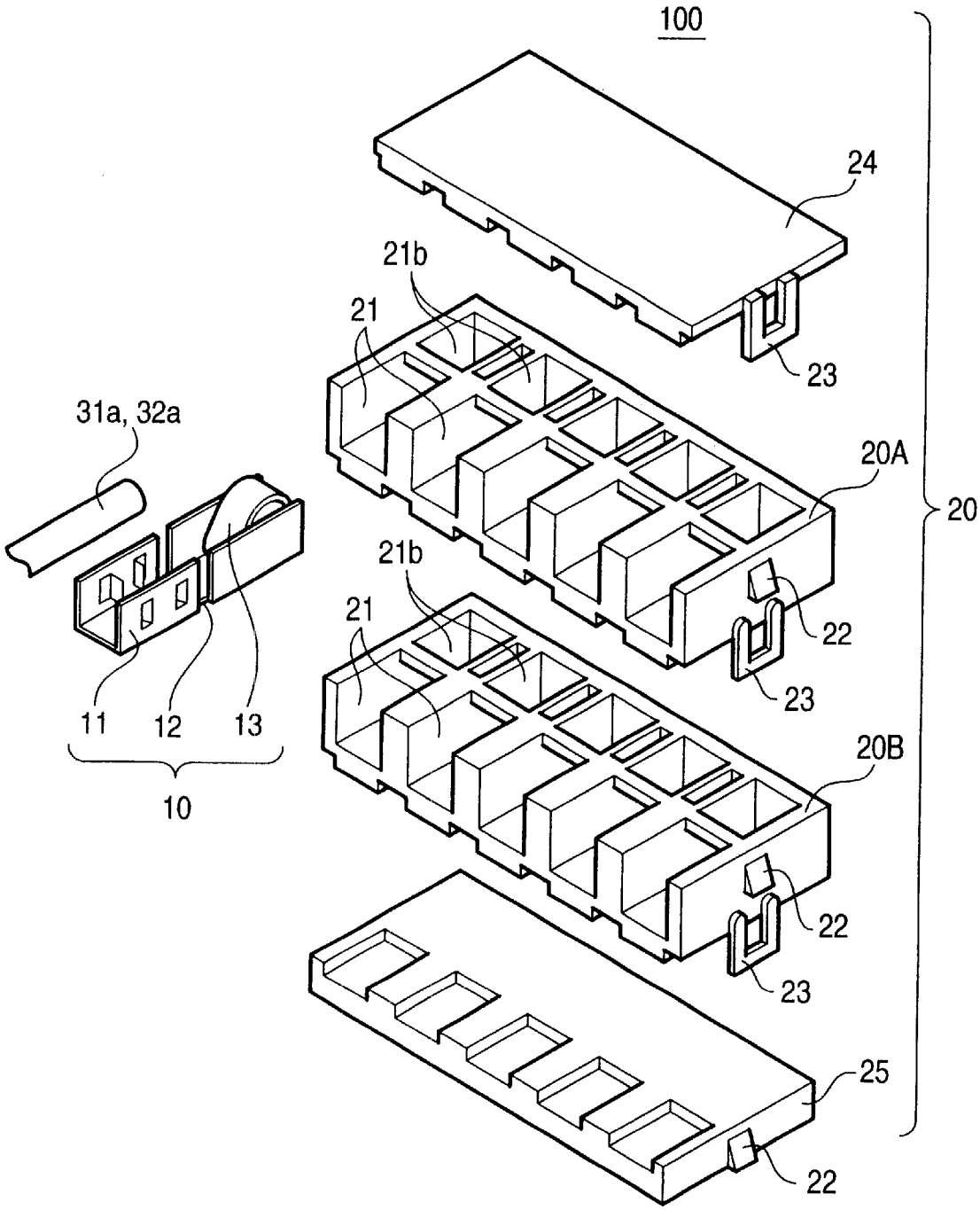
FIG. 10 is an exploded, perspective view of a basic structure of a splice absorbing connector proposed by the Applicant of the present invention.
Figure 11:
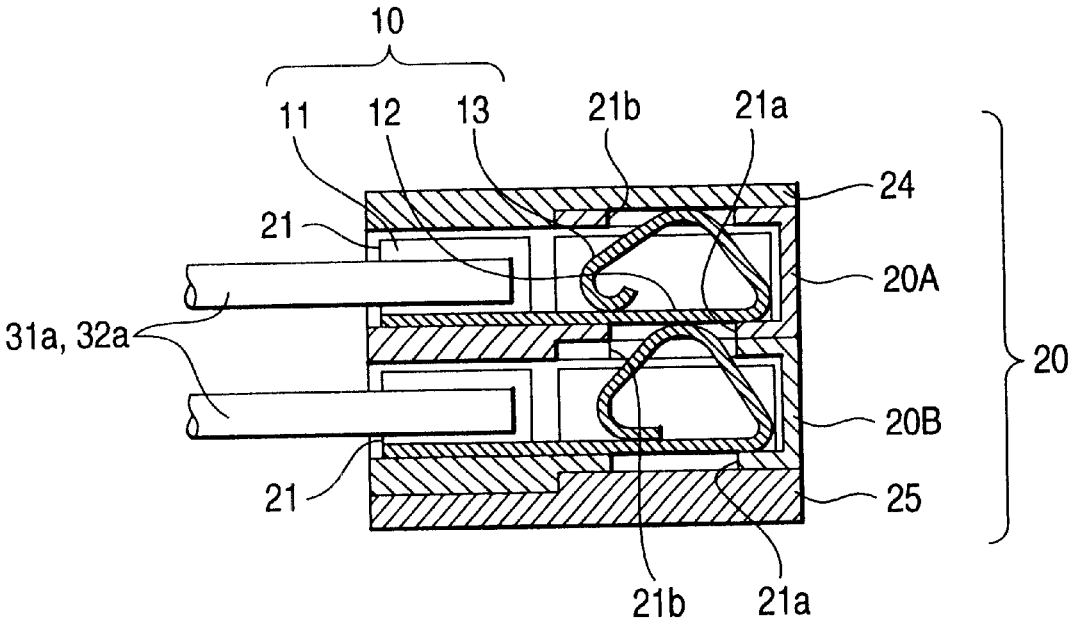
FIG. 11 is a cross-sectional view of the basic structure of the splice-absorbing connector in its assembled condition.
Figure 12:
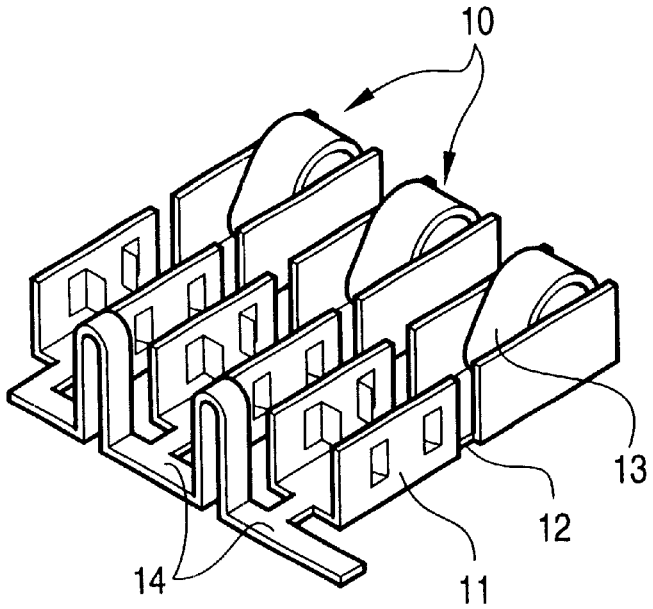
FIG. 12 is a perspective view of terminals used in the splice-absorbing connector.

FIG. 10 is an exploded, perspective view of the splice-absorbing connector of the present invention FIG. 11 is a cross-sectional view of this splice-absorbing connector in its assembled condition, and FIG. 12 is a perspective view showing terminals used in the splice-absorbing connector.

Figure 13:
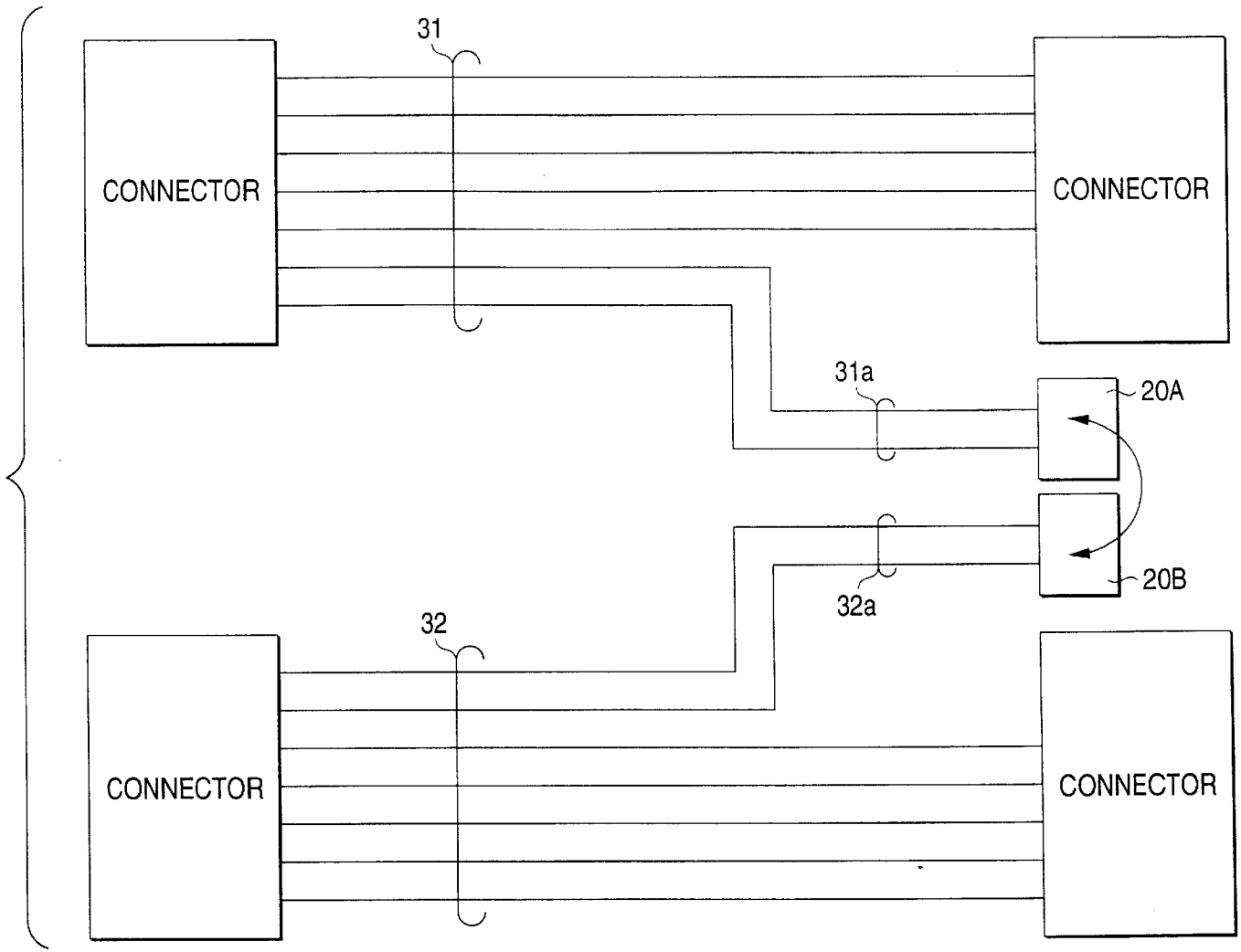
FIG. 13 is an illustration showing a condition of connection of sub-harnesses.
Figure 14:
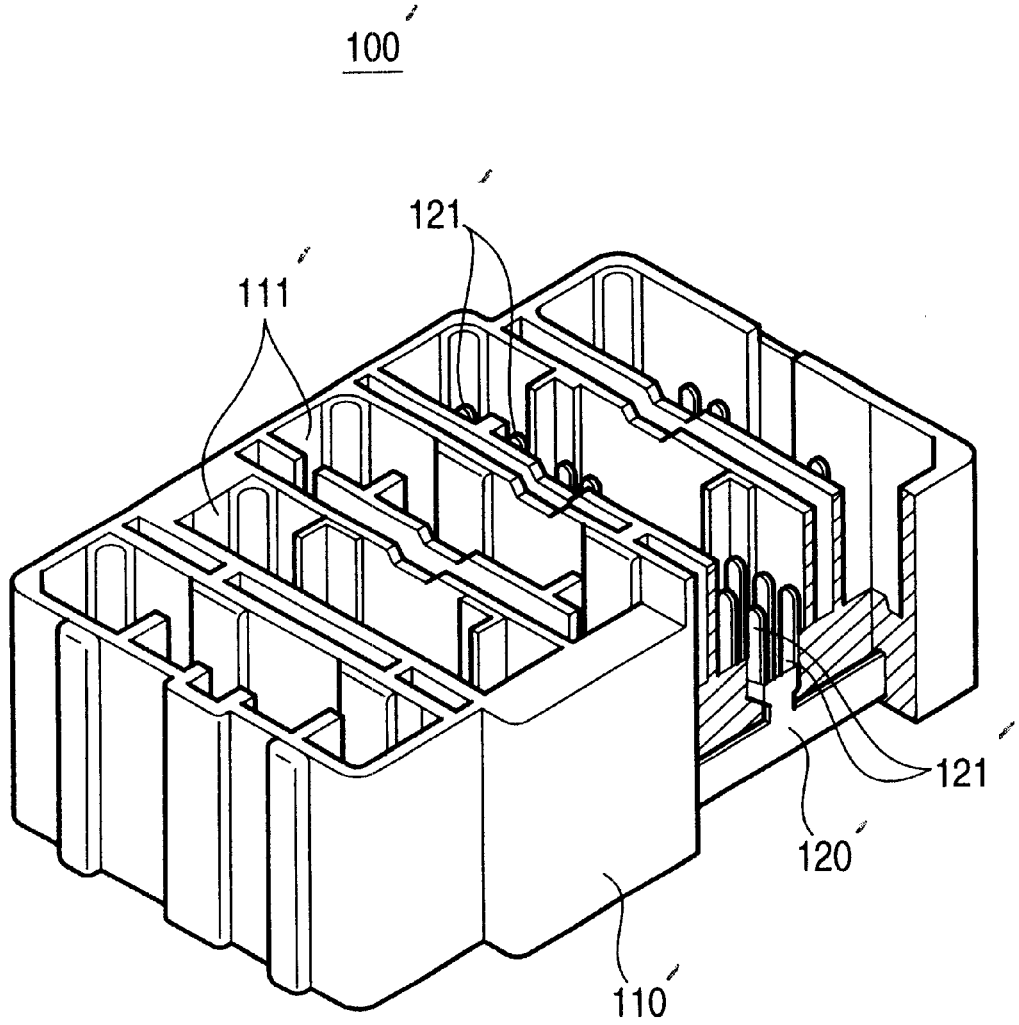
FIG. 14 shows a partially cross sectional view of a conventional joint absorbing connector.
Figure 15:
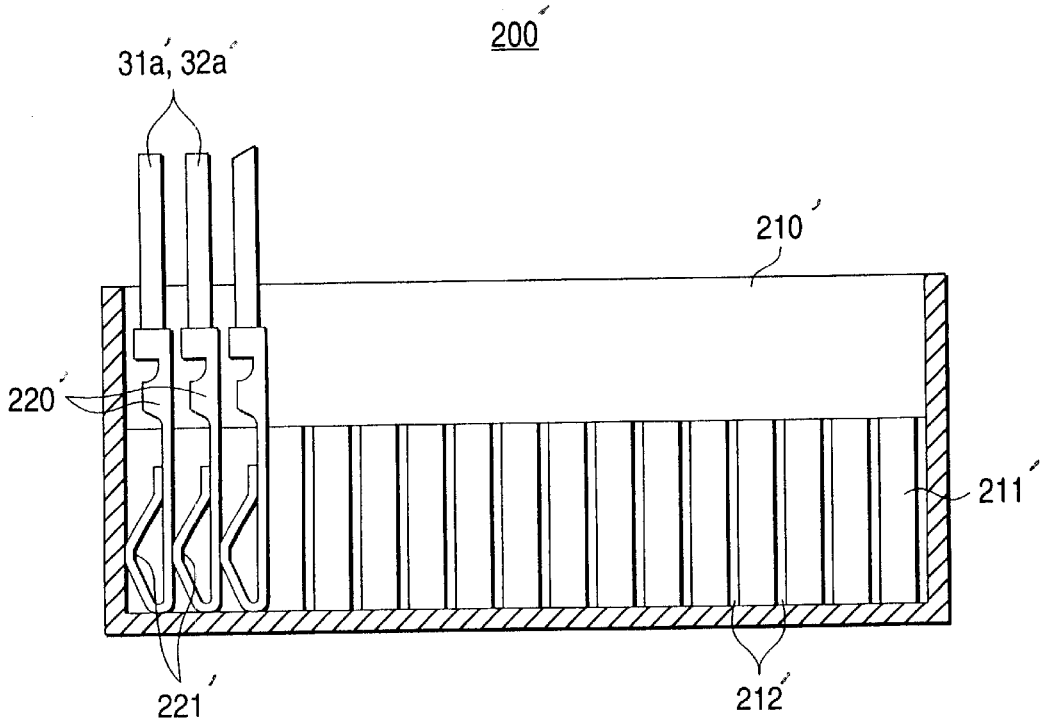
FIG. 15 shows a conventional splice absorbing connector.
Figure 15:
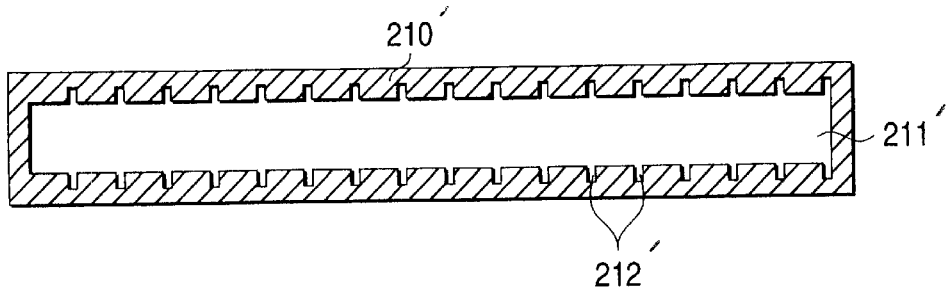
Figure 16:
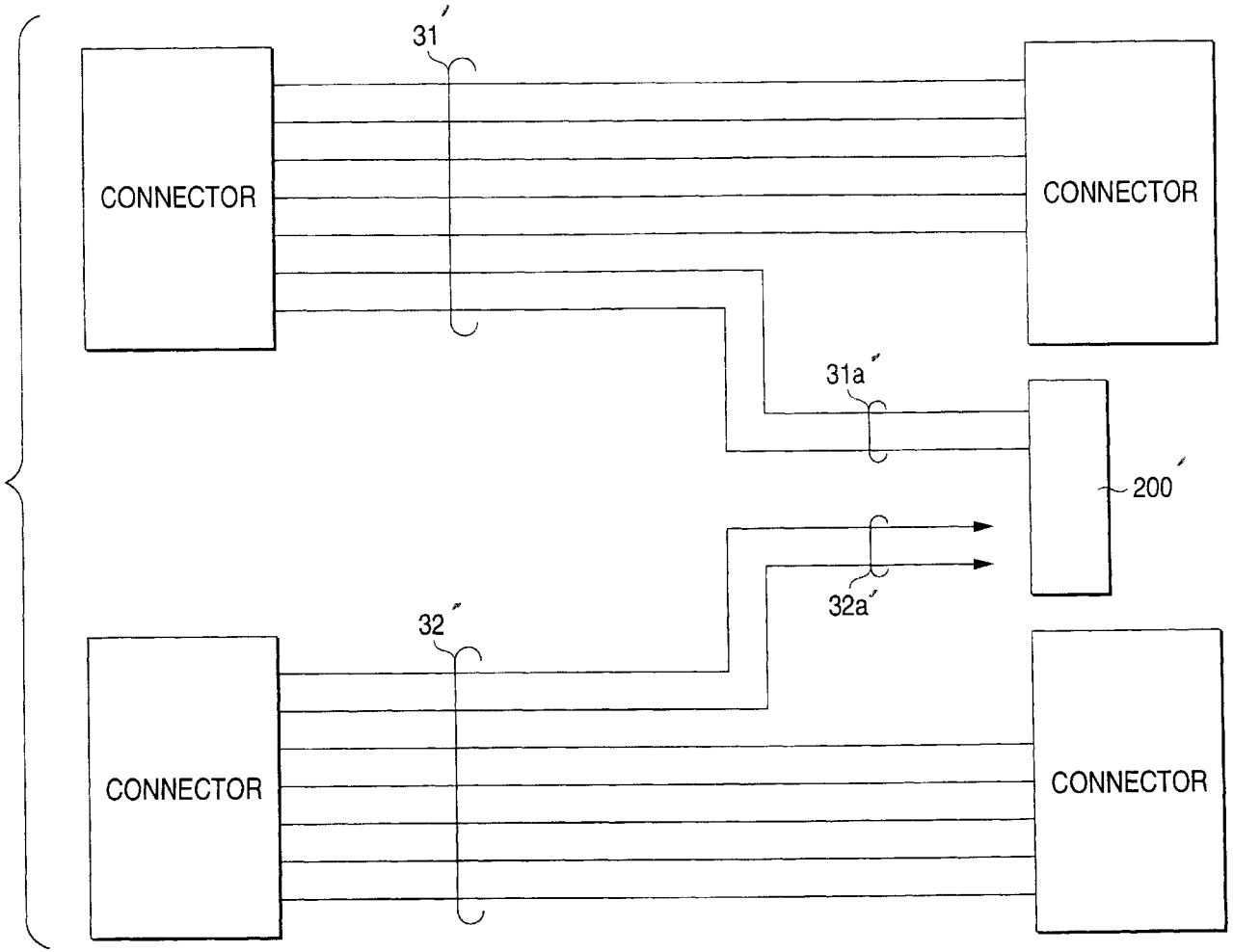
FIG. 16 shows an illustration of a connecting condition of the sub-harness through the splice absorbing connector.

FIG. 13 is an illustration showing a condition of connection of sub-harnesses by the splice-absorbing connector.

In FIGS. 10, 11 and 13, the splice-absorbing connector 100 comprises a plurality of terminals 10, connected respectively to wires 31*a* and 32*a*, branched from at least two sub-harnesses 31 and 32, and a connector housing 20 receiving these terminals 10.

The terminal 10, shown in FIG. 10, includes a press-connecting portion 11 for press-connection to the wire 31*a*, 32*a*, a flat plate-like contact portion 12, and a resilient contact portion 13 extending from the plate-like contact portion 12 to be disposed thereon.

As shown in FIGS. 10 and 11, the connector housing 20 comprises two sub-housings 20A and 20B, which can be stacked together, an upper lid 24 attached to the upper side of the upper sub-housing 20A, and a lower lid 25 attached to the lower side of the lower sub-housing 20B.

The sub-housings 20A and 20B have the same construction, and each of them has a plurality of terminal receiving chambers 21 for receiving the terminals 10.

Each of the terminal receiving chambers 21 has a lower opening 21*a*, corresponding to the plate-like contact portion 12 of the terminal 10, and an upper opening 21*b* corresponding to the resilient contact portion 13 of the terminal 10.

The terminals 10 of the wires 31*a*, branched from the sub-harness 31 (shown in FIG. 13), are received in the terminal receiving chambers 21 in the sub-housing 20A, and the terminals 10 of the wires 32*a*, branched from the sub-harness 32 (shown in FIG. 13), are received in the terminal receiving chambers 21 in the sub-housing 20B.

When the terminal 10 is received in the terminal receiving chamber 21, the plate-like contact portion 12 is exposed through the lower opening 21*a* while the resilient contact portion 13 projects through the upper opening 21*b*, as shown in FIG. 11.

As shown in FIG. 10, a retaining claw 22 and a retaining loop portion 23 are integrally formed respectively on an upper portion and a lower portion of each of opposite side surfaces of the sub-housing 20A, 20B.

When the sub-housings 20A and 20B are stacked together, the retaining loop portions 23 of the upper sub-housing 20A are fitted respectively on the retaining claws 22 of the lower sub-housing 20B, thereby holding the two sub-housings 20A and 20B together.

In this condition, the lower openings 21*a* in the sub-housing 20A communicate respectively with the upper openings 21*b* in the sub-housing 20B, and the resilient contact portion 13 of each terminal 10, received in the terminal receiving chamber 21 in the sub-housing 20B, contacts the plate-like contact portion 12 of the corresponding terminal 10 received in the terminal receiving chamber 21 in the sub-housing 20A.

As a result, the wires 31*a* of the sub-harness 31 (FIG. 13) are connected to the wires 32*a* of the sub-harness 32, respectively (Splices in a vertical direction are absorbed).

When the terminals 10, received respectively in the adjoining terminal receiving chambers 21 in the same sub-housing 20A or 20B, are to be connected together (that is, in the case of absorbing splices in a horizontal direction), a relevant portion of a carrier (interconnecting band) 14, formed during the production of the terminals 10 by pressing, is left, and is suitably bent. By doing so, the terminals 10 are connected together.

Referring back to FIGS. 10 and 11, the upper lid 24 has retaining loop portions 23 for fitting respectively on the retaining claws 22 of the sub-housing 20A. The upper lid 24 is attached to the upper side of the sub-housing 20A to close the upper openings 21*b* formed respectively in the terminal receiving chambers 21.

Therefore, the resilient contact portion 13 of each terminal 10 is prevented from being exposed through the corresponding upper opening 21*b* in the sub-housing 20A.

The lower lid 25 has retaining claws 22 for being engaged respectively in the retaining loop portions 23 of the sub-housing 20B. The lower lid 25 is attached to the lower side of the sub-housing 20B to close the lower openings 21*a* formed respectively in the terminal receiving chambers 21.

Therefore, the plate-like contact portion 12 of each terminal 10 is prevented from being exposed through the corresponding lower opening 21*b* in the sub-housing 20B.

By increasing and decreasing the number of the sub-housings 20A, 20B, . . . , jointly forming the connector housing 20, the splice-absorbing connector 100 of this construction can flexibly meet a change in the number of the wires 31*a* and 32*a*, branched from the sub-harnesses 31 and 32, and a change in the connection pattern.

The splice-absorbing connector 100 comprises not smaller than two sub-housings 20A and 20B, and therefore the connector housing, jointly formed by these sub-housings, can be extended in two directions, that is, in the vertical and horizontal directions. Therefore, even when circuits in a vehicle increase, and become complicated, the overall size of the splice-absorbing connector 100 can be made compact.

The terminals 10 for the sub-harness 31 need to be fitted only in the sub-housing 20A whereas the terminals 10 for the sub-harness 32 need to be fitted only in the sub-housing 20B, and after the two sub-harnesses 31 and 32 are completed, the wires 31*a*, branched from the sub-harness 31, can be connected respectively to the wires 32*a*, branched from the sub-harness 32, merely by stacking the sub-housings 20A and 20B together, and therefore the efficiency of production of the wire harness can be enhanced.

In addition, the terminals 10, received respectively in the adjoining terminal receiving chambers 21 in the same sub-housing 20A or 20B, can be connected together, utilizing the carrier 14 formed during the production of the terminals 10 by pressing.

And besides, the adjoining terminals 10 can be easily connected together and insulated from each other by leaving and cutting the carrier 14.

First Embodiment

First, a first embodiment of a splice-absorbing connector of the invention will be described with reference to FIGS. 1 to 3.

Figure 1:
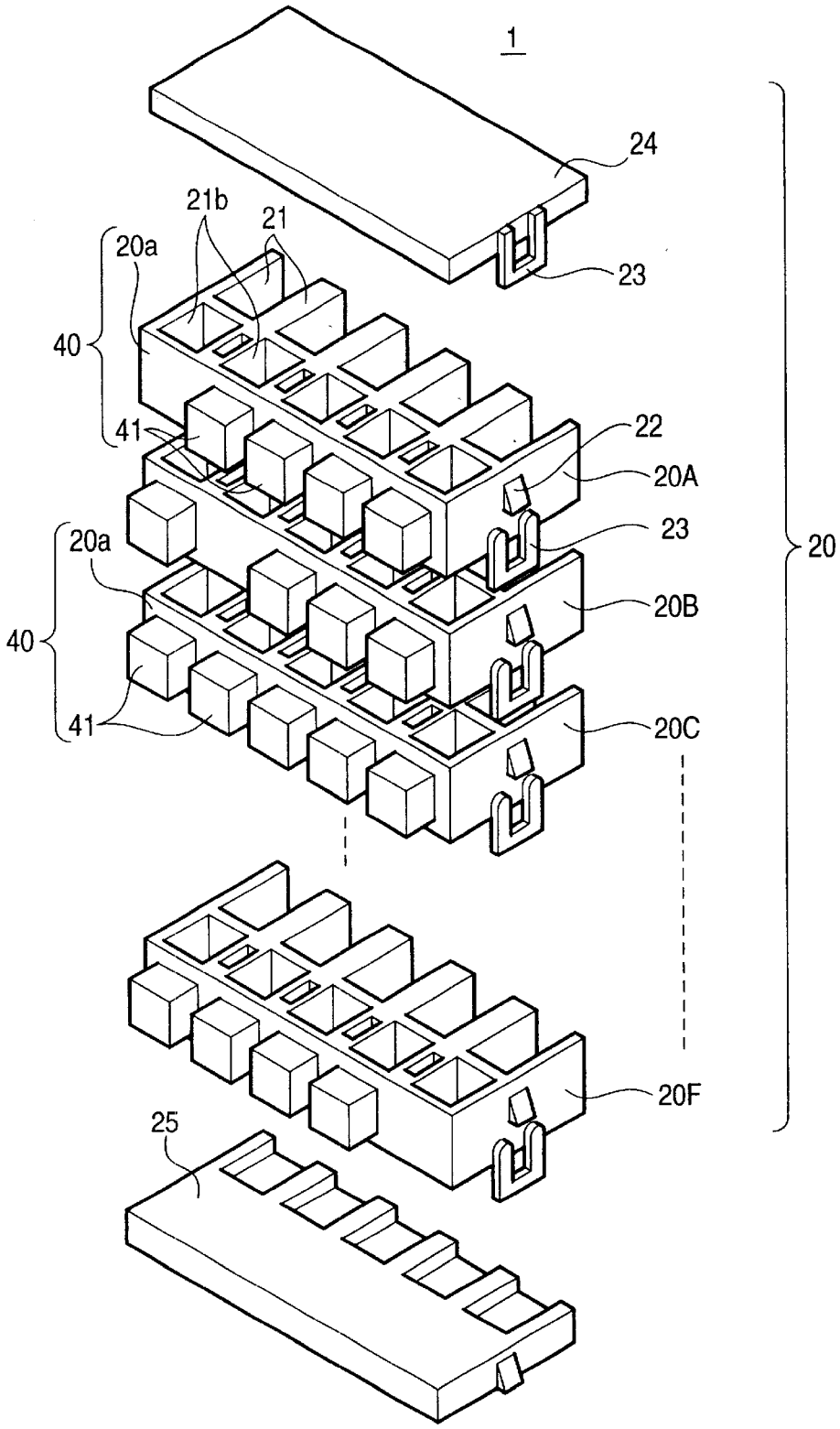
FIG. 1 is a perspective view of a preferred embodiment of a splicing-absorbing connector of the invention.
Figure 2:
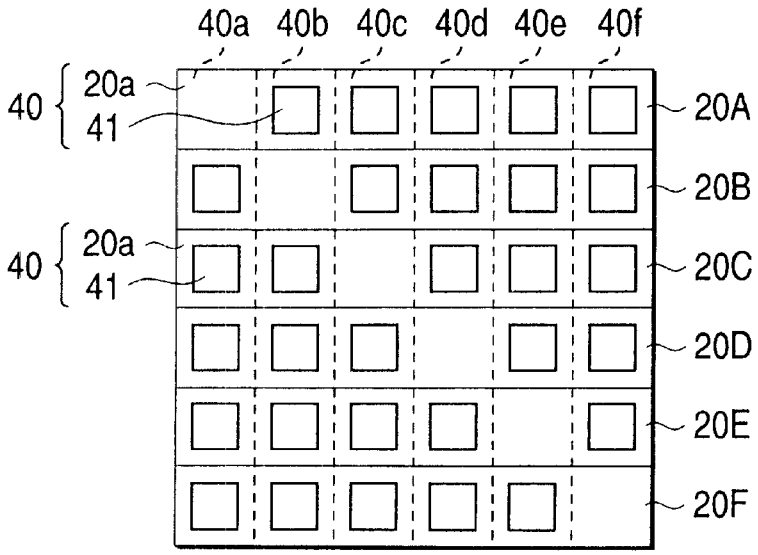
FIGS. 2A and 2B are a front-elevational view of sub-housings forming the splice-absorbing connector.
Figure 2:
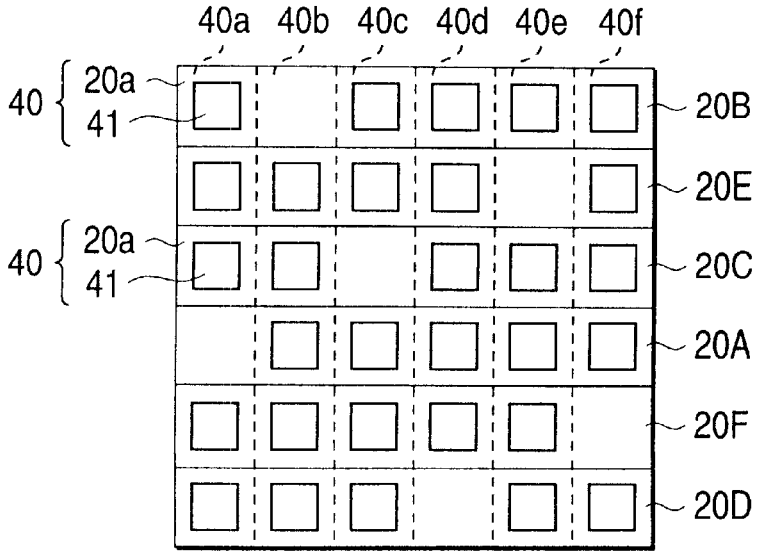

FIG. 1 is a perspective view of the splice-absorbing connector of this embodiment.

FIGS. 2A and 2B are a front-elevational view of sub-housings forming the splice-absorbing connector.

Figure 3:
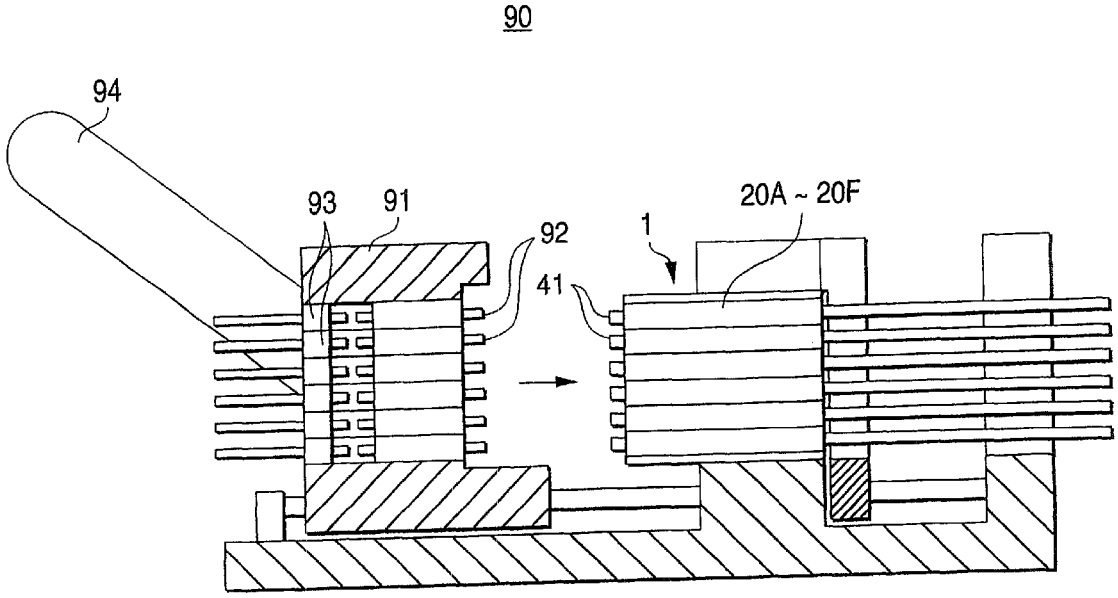
FIG. 3 is a partly-cross-sectional view showing an inspection instrument for judging whether or not the order of stacking of the sub-housings is correct.

FIG. 3 is a partly-cross-sectional view showing an inspection instrument for judging whether or not the order of stacking of the sub-housings is correct.

The splice-absorbing connector of the invention is an improvement over the splice-absorbing connector shown in FIG. 10, and those portions thereof identical to those of the splice-absorbing connector of FIG. 10 will be designated by identical reference numerals, respectively, and detailed explanation thereof will be omitted.

In FIGS. 1 and 2A, the splice-absorbing connector 1 of this embodiment comprises six sub-housings 20A, 20B, 20C, 20D, 20E and 20F, and order identification portions 40 are formed respectively on one surface (front surfaces in this embodiment) 20*a* of each of these sub-housings 20A to 20F which will not overlap each other, and are disposed in a common plane.

The order identification portions 40 of the sub-housings 20A to 20F are different in appearance from one another, and mean predetermined stack order positions of the sub-housings 20A to 20F, respectively.

In this embodiment, the one surface 20*a* of each of the sub-housings 20A to 20F is imaginarily divided into six sections 40*a*, 40*b*, 40*c*, 40*d*, 40*e* and 40*f* equal in number to the (six) sub-housings 20A to 20F to be stacked together, and three-dimensional (cubic) convex marks 41, 41, 41, 41 and 41, forming the order identification portion 40, are formed respectively on these sections 40*a* to 40*f* of each sub-housing 20A to 20F except that section (40*a* to 40*f*) corresponding to the stack order position thereof.

In other words, the three-dimensional mark 41 is not formed only on that section 40*a* to 40*f* of each sub-housing 20A to 20F corresponding to the stack position order thereof, and in this manner, the stack order positions of the sub-housings 20A to 20F are indicated.

For example, the three-dimensional mark 41 is not formed on the first section 40*a* of the order identification portion 40 of the first-stage sub-housing 20A, and the three-dimensional mark 41 is not formed on the second section 40*a* of the order identification portion 40 of the second-stage sub-housing 20B.

In the splice-absorbing connector 1 of this embodiment having the above construction, the stack order position of each of the sub-housings 20A to 20F can be identified in accordance with the position of that section 40*a* to 40*f* of its order identification portion 40 having no three-dimensional mark 41 formed thereon, and therefore an error in the order of stacking of the sub-housings 20A to 20F can be prevented.

When the sub-housings 20A to 20F are stacked together in the correct order as shown in FIG. 2A, those sections 40*a* to 40*f* of the sub-housings 20A to 20F, each having no three-dimensional mark 41 formed on the order identification portion 40, are arranged straight on a diagonal line of the s tacked sub-housings 20A to 20F, thus jointly forming a pattern of a predetermined regularity.

On the other hand, when the order of stacking of the sub-housings 20A to 20F is erroneous as shown in FIG. 2B, those sections 40*a* to 40*f* of the sub-housings 20A to 20F, each having no three-dimensional mark 41 formed on the order identification portion 40, are not arranged in a regular manner, thus forming an irregular pattern giving an unusual impression.

Therefore , the operator takes a look at such a three-dimensional configuration pattern to determine whether or not this pattern has the predetermined regularity, and merely by doing so, it can be immediately judged whether or not the order of stacking of the sub-housings 20A to 20F is correct, and also it can be immediately judged where and how the stacking order is erroneous.

Whether or not the order of stacking of the sub-housings 20A to 20F is correct can also be judged by the use of the inspection instrument 90 shown in FIG. 3.

In this Figure, the inspection instrument 90 includes an inspection instrument body 91 movable toward and away from the stacked sub-housings 20A to 20F.

Movable detection pins 92, corresponding respectively to the sections 40*a* to 40*f* (6×6=36 sections; see FIG. 2A) of the order identification portions 40 of the sub-housings 20A to 20F, are received in the inspection instrument body 91.

Switches 93 for respectively detecting the retractions of the detection pins 92 are provided rearwardly of the detection pins 92, respectively.

In this inspection instrument 90, when a lever 94 is operated to move the inspection instrument body 91 toward the sub-housings 20A to 20F, only those detection pins 92, which abut respectively against the associated three-dimensional marks 41 on the order identification portions 40, are retracted to operate the associated switches 93, respectively.

In accordance with this operation of the switches 93, it can be judged whether or not the order of stacking of the sub-housings 20A to 20F is correct.

Whether or not the order of stacking of the sub-housings 20A to 20F is correct can also be judged by the use of a commonly-used image analysis device (not shown).

Next, a second embodiment of a splice-absorbing connector of the invention will be described with reference to FIGS. 4A and 4B.

Figure 4:
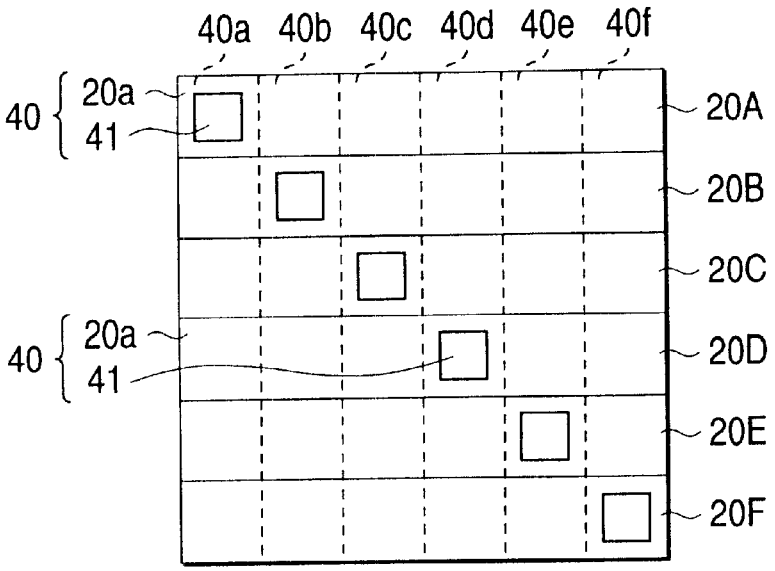
FIGS. 4A and 4B are a front-elevational view of sub-housings forming a second embodiment of a splice-absorbing connector of the invention.
Figure 4:
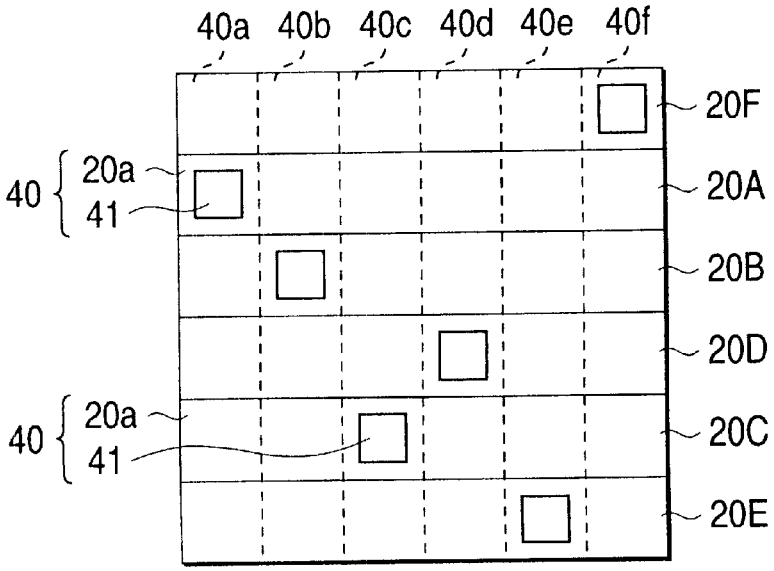

FIGS. 4A and 4B are a front-elevational view of sub-housings forming the splice-absorbing connector of this second embodiment.

In this embodiment, as shown in FIG. 4A, a three-dimensional mark 41 is formed only on that section 40*a* to 40*f* of an order identification portion 40 of each of the sub-housings 20A to 20F corresponding to a stack order position thereof, and in this manner, the stack order positions of the sub-housings 20A to 20F are indicated. Namely, the order identification portion 40 has a construction reverse to that described above for the first embodiment.

In this construction, the stack order position of each of the sub-housings 20A to 20F can be identified in accordance with the position of the three-dimensional mark 41 formed on the order identification portion 40, and therefore an error in the order of stacking of the sub-housings 20A to 20F can be prevented.

When the sub-housings 20A to 20F are stacked together in the correct order as shown in FIG. 4A, the three-dimensional marks 41, formed respectively on the order identification portions 40 of the sub-housings 20A to 20F, are arranged straight on a diagonal line of the stacked sub-housings 20A to 20F, thus jointly forming a pattern of a predetermined regularity.

On the other hand, when the order of stacking of the sub-housings 20A to 20F is erroneous as shown in FIG. 4B, the three-dimensional marks 41, formed respectively on the order identification portions 40, are not arranged in a regular manner, thus forming an irregular pattern giving an unusual impression.

Therefore, such a three-dimensional configuration pattern is judged with the eyes or other means so as to determine whether or not this pattern has the predetermined regularity, and by doing so, it can be immediately judged whether or not the order of stacking of the sub-housings 20A to 20F is correct, and also it can be immediately judged where and how the stacking order is erroneous.

Next, a third embodiment of a splice-absorbing connector of the invention will be described with reference to FIGS. 5A and 5B.

Figure 5:
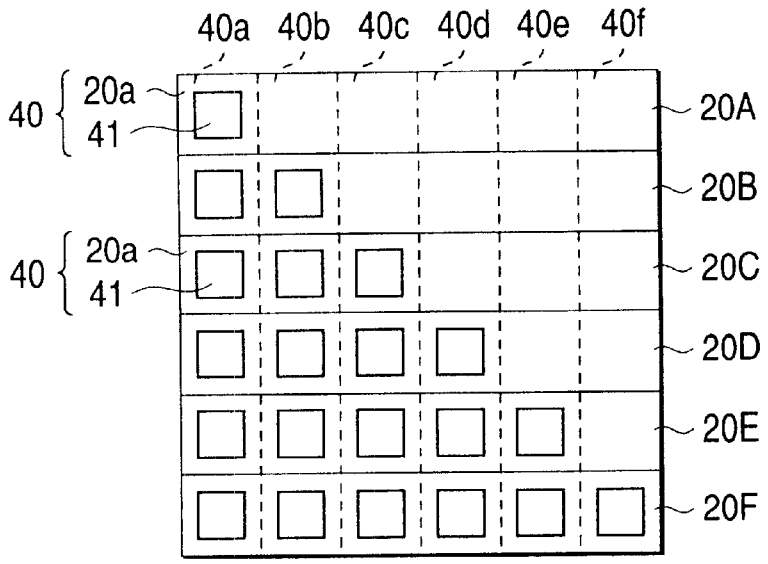
FIGS. 5A and 5B are a front-elevational view of sub-housings forming a third embodiment of a splice-absorbing connector of the invention.
Figure 5:
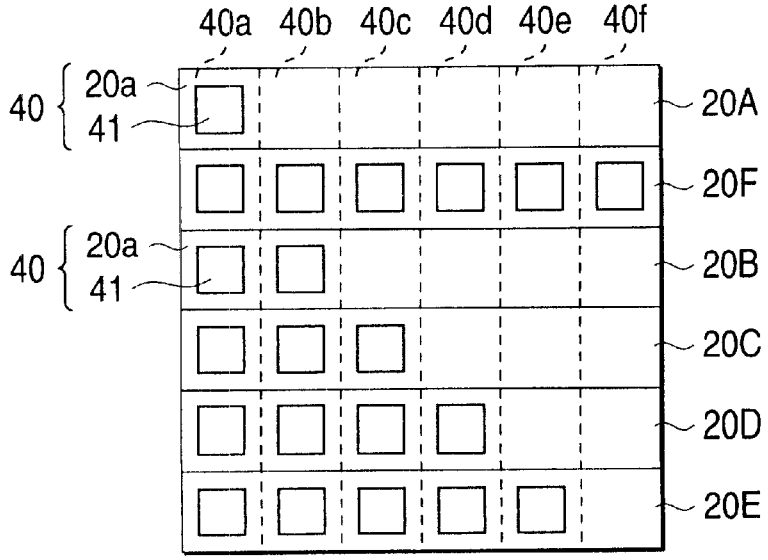

FIGS. 5A and 5B are a front-elevational view of sub-housings forming the splice-absorbing connector of this third embodiment.

In this embodiment, as shown in FIG. 5A, an order identification portion 40, formed on one surface 20*a* of each of sub-housings 20A to 20B, has a three-dimensional mark or marks 41 whose number is the same as a stack order position number thereof, and are arranged at equal intervals in a juxtaposed manner.

In this construction, the stack order position of each of the sub-housings 20A to 20F can be identified in accordance with the number of the three-dimensional marks 41 on the order identification portion 40, and therefore an error in the order of stacking of the sub-housings 20A to 20F can be prevented.

When the sub-housings 20A to 20F are stacked together in the correct order as shown in FIG. 5A, the three-dimensional marks 41 of the order identification portions 40 jointly form such a three-dimensional configuration pattern of a predetermined regularity that the number of the three-dimensional marks 41 is increased one by one in the sequence from the first-stage sub-housing 20A toward the last-stage sub-housing 20F.

On the other hand, when the order of stacking of the sub-housings 20A to 20F is erroneous as shown in FIG. 5B, the three-dimensional marks 41 fail to provide the predetermined regularity, thus forming an irregular pattern giving an unusual impression.

Therefore, such a three-dimensional configuration pattern is judged with the eyes or other means so as to determine whether or not this pattern has the predetermined regularity, and by doing so, it can be immediately judged whether or not the order of stacking of the sub-housings 20A to 20F is correct, and also it can be immediately judged where and how the stacking order is erroneous.

Next, a fourth embodiment of splice-absorbing connectors of the invention will be described with reference to FIGS. 6A, 6B and 6C.

Figure 6:
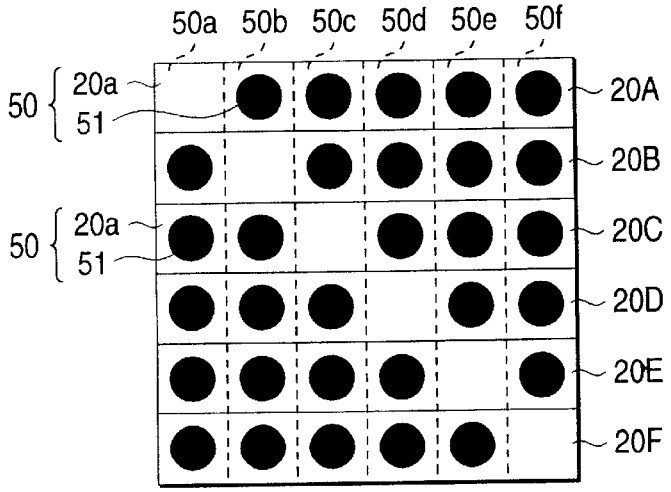
FIGS. 6A, 6B and 6C are front-elevational views of sub-housings forming a fourth embodiment of splice-absorbing connectors of the invention.
Figure 6:
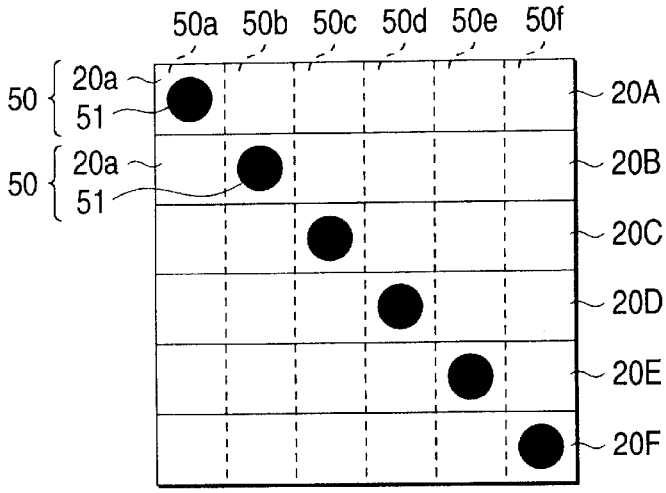
Figure 6:
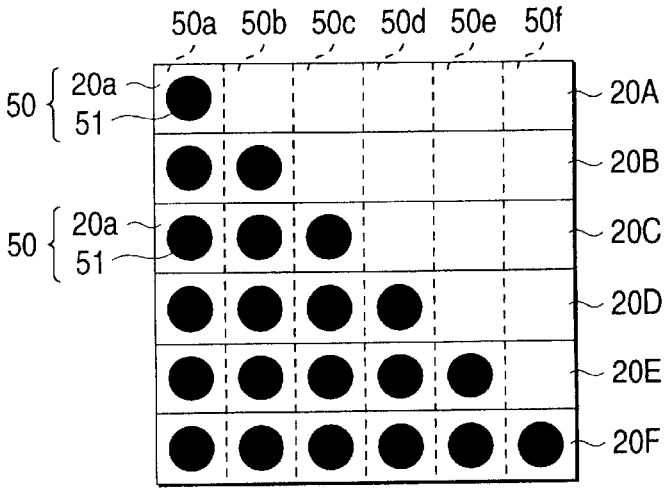

FIGS. 6A, 6B and 6C are front-elevational views of sub-housings of the splice-absorbing connectors of this fourth embodiment, respectively.

In the splice-absorbing connectors of FIGS. 6A, 6B and 6C, instead of the three-dimensional marks 41 formed on the order identification portions 40 of the first, second and third embodiments, planar marks 51 are formed on predetermined sections 50*a*, 50*b*, 50*c*, 50*d*, 50*e* and 50*f* of order identification portions 50 of the sub-housings 20A to 20F.

In this construction, also, the order of stacking of the sub-housings 20A to 20F can be clearly identified from the appearance as described above for the first, second and third embodiments, and therefore an error in the order of stacking of the sub-housings 20A to 20F is prevented, and also it can be immediately judged where and how the stacking order is erroneous.

Next, a fifth embodiment of splice-absorbing connectors of the invention will be described with reference to FIGS. 7A, 7B and 7C.

Figure 7:
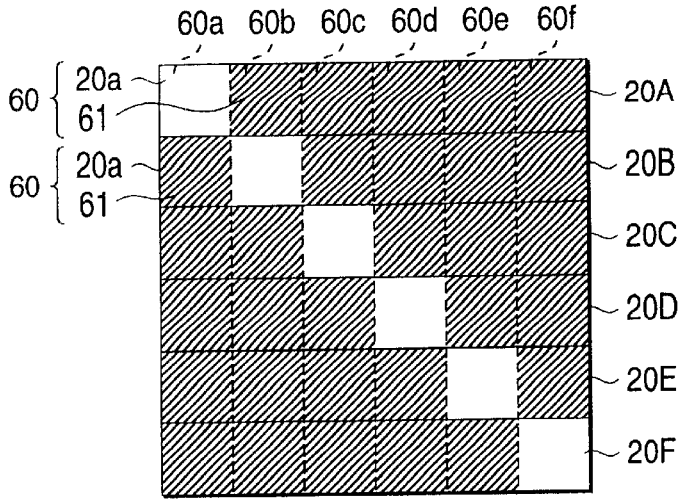
FIGS. 7A, 7B and 7C are front-elevational views of sub-housings forming a fifth embodiment of splice-absorbing connectors of the invention.
Figure 7:
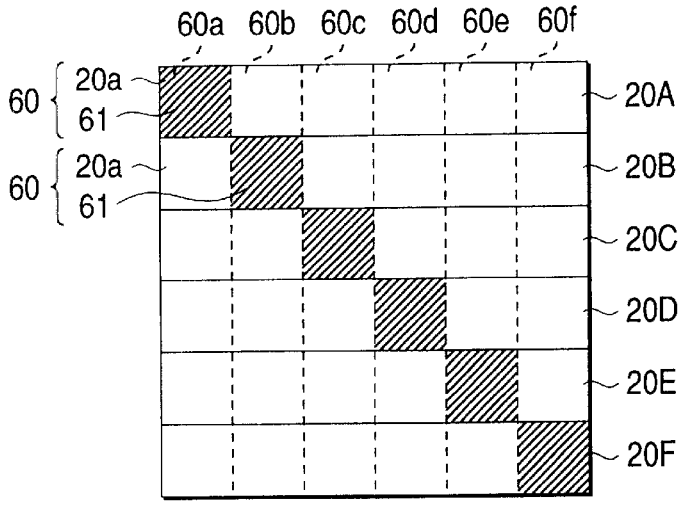
Figure 7:
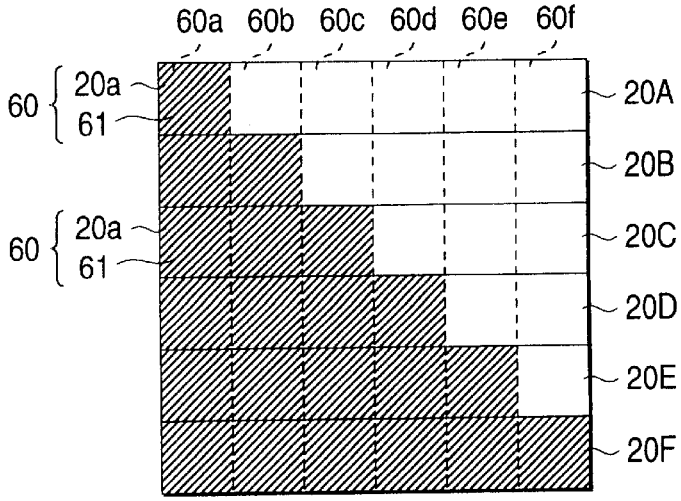

FIGS. 7A, 7B and 7C are front-elevational views of sub-housings of the splice-absorbing connectors of this fifth embodiment, respectively.

In the splice-absorbing connectors of FIGS. 7A, 7B and 7C, instead of the three-dimensional marks 41 formed on the order identification portions 40 of the first, second and third embodiments, a color is applied to predetermined sections 60*a*, 60*b*, 60*c*, 60*d*, 60*e* and 60*f* of order identification portions 60 of the sub-housings 20A to 20F.

In this construction, also, the order of stacking of the sub-housings 20A to 20F can be clearly identified from the appearance as described above for the first, second and third embodiments, and therefore an error in the order of stacking of the sub-housings 20A to 20F is prevented, and also it can be immediately judged where and how the stacking order is erroneous.

Next, a six embodiment of splice-absorbing connectors of the invention will be described with reference to FIGS. 8A and 8B.

Figure 8:
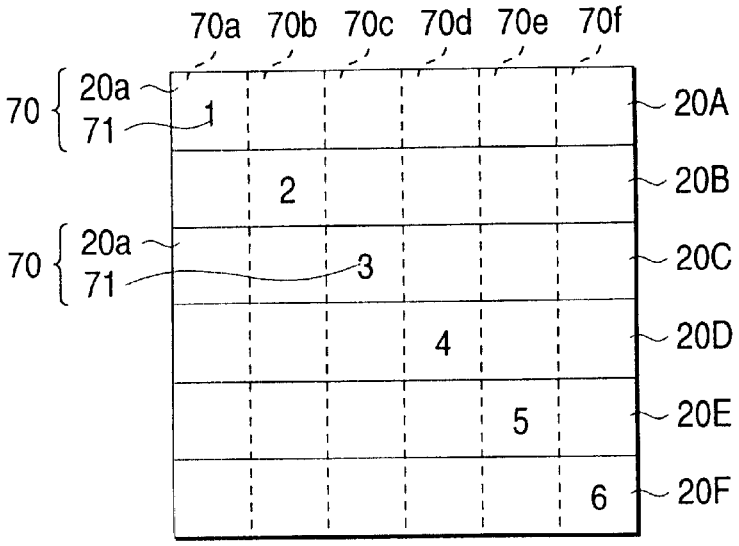
FIGS. 8A and 8*b* are front-elevational views of sub-housings forming a sixth embodiment of splice-absorbing connectors of the invention.
Figure 8:
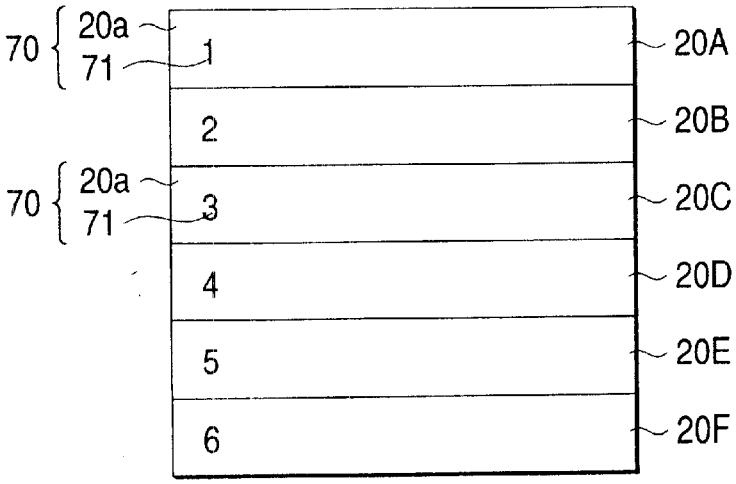

FIGS. 8A and 8B are front-elevational views of sub-housings of the splice-absorbing connectors of this sixth embodiment, respectively.

In the splice-absorbing connector shown in FIG. 8A, one surface 20*a* of each of the sub-housings 20A to 20F is imaginarily divided into six sections 70*a*, 70*b*, 70*c*, 70*d*, 70*e* and 70*f* equal in number to the (six) sub-housings 20A to 20F to be stacked together. A number mark 71 ("1" to "6"), forming an order identification portion 70, is indicated on that section 70*a* to 70*f* of each sub-housing 20A to 20F corresponding to a stack order position thereof.

In this construction, the sub-housings 20A to 20F are stacked together in accordance with the number marks "1" to "6" indicated respectively on these sub-housings 20A to 20F, and by doing so, an error in the stacking order can be prevented.

When the sub-housings 20A to 20F are stacked together in the correct order, the number marks 71, formed respectively on the order identification portions 70 of the sub-housings 20A to 20F, are arranged straight on a diagonal line of the stacked sub-housings 20A to 20F, thus jointly forming a pattern of a predetermined regularity.

In the splice-absorbing connector shown in FIG. 8B, a number mark 71 ("1" to "6"), forming an order identification portion 70, is indicated on one surface 20*a* of each of the sub-housings 20A to 20F, and the number ("1" to "6") of the number mark 71 of each sub-housing 20A to 20F is the same as the stack order position number thereof.

In this construction, the sub-housings 20A to 20F are stacked together in accordance with the number marks "1" to "6" indicated respectively on these sub-housings 20A to 20F, and by doing so, an error in the stacking order can be prevented.

Next, a seventh embodiment of a splice-absorbing connector of the invention will be described with reference to FIGS. 9A and 9B.

Figure 9:
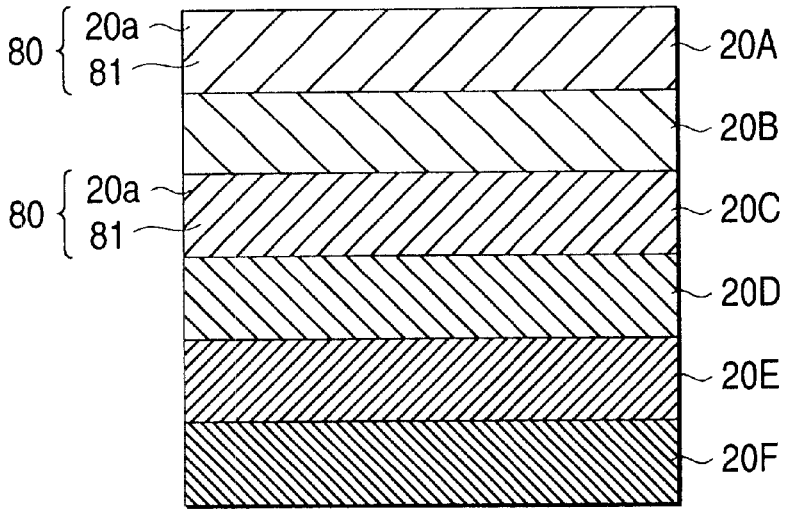
FIGS. 9A and 9*b* are front-elevational views of sub-housings forming a seventh embodiment of splice-absorbing connectors of the invention.
Figure 9:
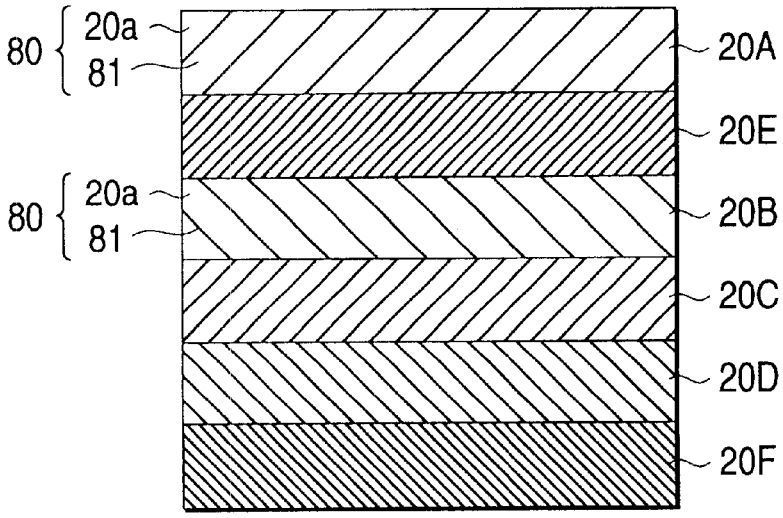

FIGS. 9A and 9B are a front-elevational view of sub-housings of the splice-absorbing connector of this seventh embodiment.

In the splice-absorbing connector of this embodiment shown in FIG. 9A, different colors 81, each forming an order identification portion 80, are applied to one surfaces 20*a* of the sub-housings 20A to 20F, respectively.

For example, the color 81 of the order identification portion 80 of the first-stage sub-housing is red, the color 81 of the second-stage sub-housing is green, the color 81 of the third-stage sub-housing is blue, and so on. Thus, such suitable colors are provided in accordance with the stacking order of the sub-housings 20A to 20F. In this manner, the colors 81 indicate the stack order positions of the sub-housings, respectively.

In this construction, the stack order position of each sub-housings 20A to 20F can be identified in accordance with the color 81 of the order identification portion 80 thereof, and an error in the order of stacking of the sub-housings 20A to 20F can be prevented.

When the sub-housings 20A to 20F are stacked together in the correct order as shown in FIG. 9A, the colors 81 of these sub-housings are arranged in a predetermined order (for example, red→green→blue, . . . ), thereby jointly forming a color pattern of a predetermined regularity.

On the other hand, when the order of stacking of the sub-housings 20A to 20F is erroneous as shown in FIG. 9B, the colors 81 of these sub-housings jointly form a color pattern different from the predetermined color pattern.

Such a color pattern is judged with the eyes or other means so as to determine whether or not this color pattern has the predetermined regularity, and by doing so, it can be immediately judged whether or not the order of stacking of the sub-housings 20A to 20F is correct, and also it can be immediately judged where and how the stacking order is erroneous.

As described above, in the splice-absorbing connectors of the present invention, the order of stacking of the sub-housings can be clearly identified from the appearance, and therefore an error in the order of stacking of the sub-housings can be prevented, and besides it can be immediately judged where and how the stacking order is erroneous.

What is claimed is:

1. A splice-absorbing connector comprising:

connector housing including a plurality of sub-housings stacked together;

order identification portions indicating stack order positions of said sub-housings, respectively, said order identification portions being different in appearance from one another, being formed on one surface of each of said sub-housings which do not overlap each other, and being disposed in a common plane.

2. A splice-absorbing connector according to claim 1, in which when said sub-housings are stacked together in correct order, said order identification portions of said sub-housings jointly form a pattern of a predetermined regularity.

3. A splice-absorbing connector according to claim 1, in which said order identification portion of each of said sub-housings comprises a number mark indicated on said one surface thereof, and the number of said number mark of each sub-housing is the same as the stack order position number thereof.

4. A splice-absorbing connector according to claim 1 or claim 2, in which said order identification portion of each of said sub-housings comprises three-dimensional or planar marks which are formed on said one surface thereof at equal intervals in a juxtaposed manner, and the number of said marks is the same as the stack order position number thereof.

5. A splice-absorbing connector according to claim 1 or claim 2, in which said order identification portions of said sub-housings are formed respectively by different colors applied respectively to said one surfaces of said sub-housings.

6. A splice-absorbing connector according to claim 2, in which part or the whole of said one surface of each of said sub-housings is structurally or imaginarily divided into sections equal in number to said sub-housings stacked together, and said sections form said order identification portion, and that section of said sections of each sub-housing, corresponding to the stack order position thereof, is different in appearance from the other sections.

7. A splice-absorbing connector according to claim 6, in which a number mark is indicated on that section of said sections of said order identification portion of each sub-housing, corresponding to the stack order position thereof, and the number of said number mark of each sub-housing is the same as the stack order position number thereof.

8. A splice-absorbing connector according to claim 6, in which a three-dimensional or planar mark is formed on that section of said sections of said order identification portion of each sub-housing corresponding to the stack order position thereof.

9. A splice-absorbing connector according to claim 6, in which three-dimensional or planar marks are formed respectively on said sections of said order identification portion of each sub-housing except that section corresponding to the stack order position thereof.

10. A splice-absorbing connector according to claim 6, in which a color is applied to that section of said sections of said order identification portion of each sub-housing corresponding to the stack order position thereof.

11. A splice-absorbing connector according to claim 6, in which a color is applied to said sections of said order identification portion of each sub-housing except that section corresponding to the stack order position thereof.

* * * * *